US005232427A

United States Patent [19]

Paro

[11] Patent Number: 5,232,427

[45] Date of Patent: Aug. 3, 1993

[54] LEG STRETCHING APPARATUS

[76] Inventor: Daniel C. Paro, 111 Holt Ave., Warner Robins, Ga. 31088

[21] Appl. No.: 924,757

[22] Filed: Aug. 4, 1992

[51] Int. Cl.[5] ..... A63B 21/00

[52] U.S. Cl. ..... 482/131; 482/907; 482/148

[58] Field of Search ..... 482/148, 907, 135, 139, 482/131, 95, 91, 5, 72, 78; 128/25 R, 25 B

[56] References Cited

U.S. PATENT DOCUMENTS

| | | | |
|---|---|---|---|
| 1,007,526 | 10/1911 | Caro | 482/907 |
| 4,149,713 | 4/1979 | McLeod | 482/139 |
| 4,907,796 | 3/1990 | Gezari et al. | 482/135 |
| 5,044,355 | 9/1991 | Reopelle | 482/131 |
| 5,067,709 | 11/1991 | Christianson | 482/907 |
| 5,108,090 | 4/1992 | Reed | 482/907 |
| 5,122,106 | 6/1992 | Atwood et al. | 482/907 |
| 5,147,266 | 9/1992 | Ricard | 482/907 |

OTHER PUBLICATIONS

Black Belt Jan. 1974 p. 38 Martial Arts Supplies New Stretcher-Cizer.

*Primary Examiner*—Stephen R. Crow
*Assistant Examiner*—Jerome Donnelly
*Attorney, Agent, or Firm*—Leon Gilden

[57] ABSTRACT

An apparatus for stretching and strengthening leg muscles, particularly in use in martial arts endeavors, is provided to include a framework having a reciprocating carriage mounted slidably in a vertical orientation, with the carriage including a foot plate selectively and rotatably mounted relative to the carriage. The carriage is formed with a handle yoke operative through cable structure to effect lifting of the carriage when an individual's foot is positioned thereon. The carriage includes latching mechanism cooperative with a release mechanism mounted within the handle yoke to effect release of the carriage relative to the framework.

5 Claims, 7 Drawing Sheets

LEG STRETCHING APPARATUS

BACKGROUND OF THE INVENTION

1. Field of the Invention

The field of invention relates to leg stretching apparatus, and more particularly pertains to a new and improved leg stretching apparatus wherein the same is directed to the stretching of leg muscles as particularly utilized in a martial arts kicking motion.

2. Description of the Prior Art

Athletic activities, and particularly the activity of Karate, requires leg muscles to be stretched to permit full, effective use of such muscles in the Karate movement. While various devices have been presented in the prior art to this extent, such as exemplified in U.S. Pat. No. 4,892,304, such exercise apparatus has heretofore been of a relatively cumbersome structure, wherein the instant invention sets forth a simplified carriage arrangement permitting stretching of an individual's leg muscles. Other prior art stretching structure is exemplified in the U.S. Pat. Nos. 4,693,470; 4,743,011; and 4,936,573, wherein such prior art exercise apparatus, while of benefit in an exercise procedure, are not directed to the particular needs in Karate movement type exercise and in this respect, the present invention substantially fulfills this need.

SUMMARY OF THE INVENTION

In view of the foregoing disadvantages inherent in the known types of exercise apparatus now present in the prior art, the present invention provides a leg stretching apparatus wherein the same utilizes a carriage plate slidably mounted relative to a framework, as the carriage plate mounts an individual's foot thereon to effect stretching of the individual's leg muscles. As such, the general purpose of the present invention, which will be described subsequently in greater detail, is to provide a new and improved leg stretching apparatus which has all the advantages of the prior art leg stretching apparatus and none of the disadvantages.

To attain this, the present invention provides an apparatus for stretching and strengthening leg muscles, particularly in use in martial arts endeavors, provided to include a framework having a reciprocating carriage mounted slidably in a vertical orientation, with the carriage including a foot plate selectively and rotatably mounted relative to the carriage. The carriage is formed with a handle yoke operative through cable structure to effect lifting of the carriage when an individual's foot is positioned thereon. The carriage includes latching mechanism cooperative with a release mechanism mounted within the handle yoke to effect release of the carriage relative to the framework.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved leg stretching apparatus which has all the advantages of the prior art leg stretching apparatus and none of the disadvantages.

It is another object of the present invention to provide a new and improved leg stretching apparatus which may be easily and efficiently manufactured and marketed.

It is a further object of the present invention to provide a new and improved leg stretching apparatus which is of a durable and reliable construction.

An even further object of the present invention is to provide a new and improved leg stretching apparatus which is susceptible of a low cost of manufacture with regard to both materials and labor, and which accordingly is then susceptible of low prices of sale to the consuming public, thereby making such leg stretching apparatus economically available to the buying public.

Still yet another object of the present invention is to provide a new and improved leg stretching apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
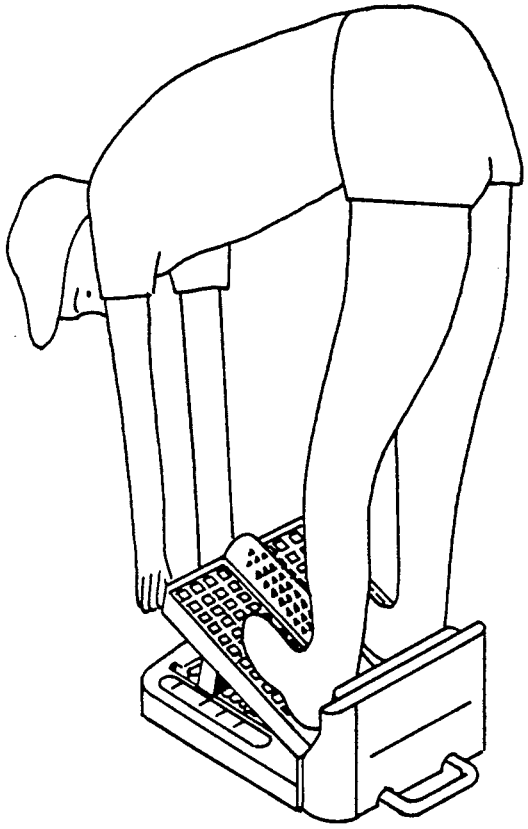
FIG. 1 PRIOR ART
FIG. 1 is an isometric illustration of a prior art stretching exercise apparatus, as exemplified in U.S. Pat. No. 4,693,470.
Figure 2:
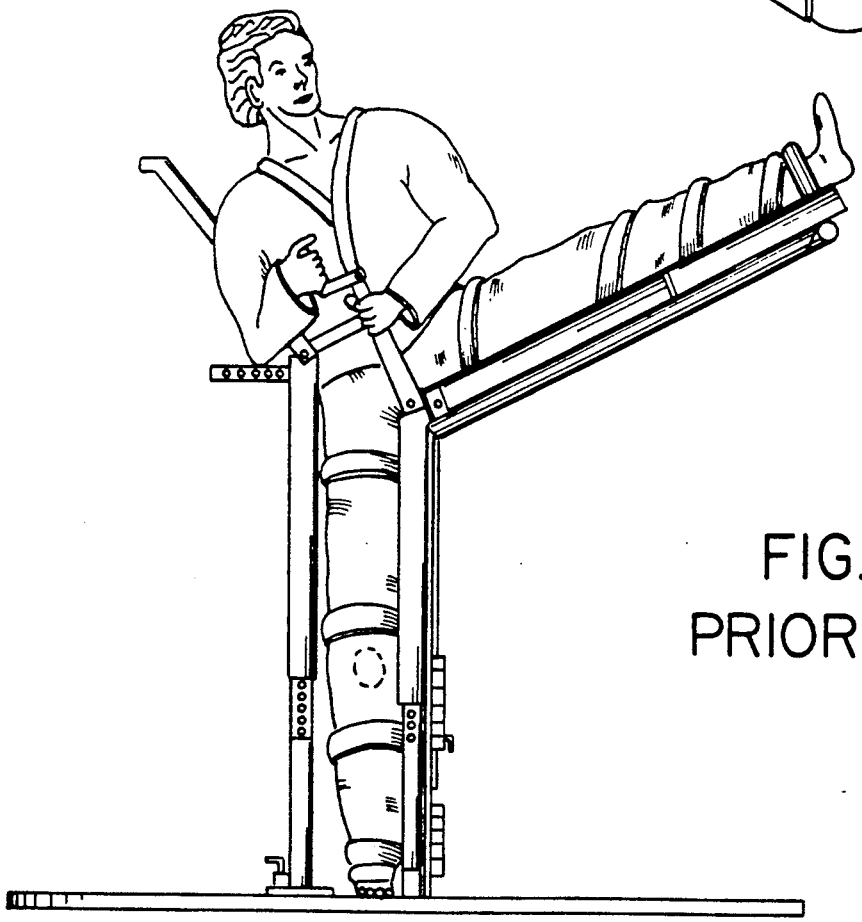
FIG. 2 PRIOR ART
FIG. 2 is an orthographic view, taken in elevation, of a prior art leg stretching apparatus, as set forth in U.S. Pat. No. 4,892, 304 as addressed to Karate exercise.
Figure 3:
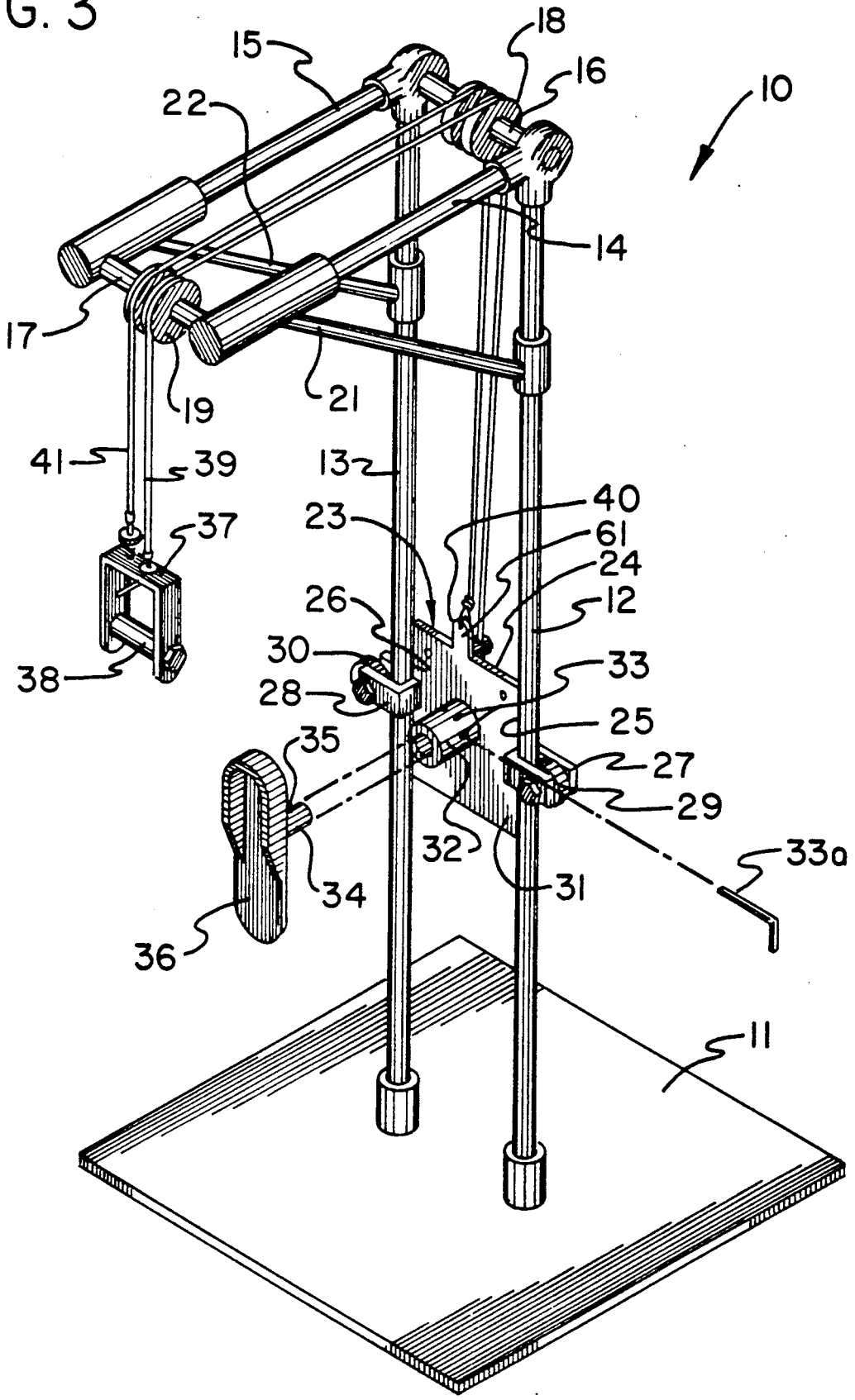
FIG. 3 is an isometric view of the invention.

With reference now to the drawings, and in particular to FIG. 3 thereof, a new and improved leg stretching apparatus embodying the principles and concepts of the present invention and generally designated by the reference numeral 10 will be described.

More specifically, the leg stretching apparatus 10 of the instant invention essentially comprises a base plate 11 arranged for mounting upon an underlying support surface, with the base plate 11 including a first support rod 12 and a second support rod 13 fixedly and orthogonally mounted to the base plate 11 in a parallel coextensive relationship relative to one another. The first and second support rods 12 and 13 include first and second support beams 14 and 15 respectively mounted orthogonally relative to the respective first and second support rods 12 and 13. A first pulley axle 16 is mounted orthogonally between the first support rod 12 and its intersection with the first support beam 14, and an intersection of the second support rod 13 and its intersection with the second support beam 15. A second pulley axle 17 is orthogonally mounted to the first and second support beams 14 and 15 in a spaced, parallel relationship relative to the first support axle 16. A first pulley member 18 is rotatably mounted about the first support axle 16, with a second pulley member 19 mounted rotatably about the second pulley axle 17. If required, a first reinforcing rod 21 is arranged to extend between the first support rod 12 and the first support beam 14, with a second reinforcing rod 22 arranged to fixedly extend between the second support rod 13 and the second support beam 15.

A carriage plate 23 is arranged for sliding reciprocation between the first and second support rods 12 and 13. The carriage plate includes a carriage top edge 24 and associated carriage first and second side edges 25 and 26 respectively, with the carriage first side edge 25 in sliding relationship along the first support beam and the second side edge 26 arranged in a sliding relationship along the second support beam. A first bifurcated head 27 and second bifurcated head 28 are mounted respectively of each of the respective carriage first and second side edges 25 and 26 mounting respective first and second rollers 29 and 30 capturing the respective first and second support beams between the respective first and second rollers 29 and 30 within the respective first and second bifurcated heads 27 and 28.

A carriage plate front wall 31 mounts a tubular socket 32, with the tubular socket including an annular array of tubular socket apertures 33 receiving a lock pin 33*a*. A foot plate 26 is provided having a cylindrical mounting shaft 34 fixedly and orthogonally mounted to the foot plate 36, with the cylindrical mounting shaft 34 including an annular array of mounting shaft apertures 35, wherein one of the mounting shaft apertures 35 is aligned with one of the socket apertures 33 to receive the lock pin 33*a* to rotatably mount in a predetermined and desired fixed orientation the foot plate 36 relative to the carriage plate front wall 31.

A U-shaped handle yoke 37 is provided, having a handlebar 38 mounted between opposed parallel side legs of the yoke 37. A first cable 39 is mounted medially of the U-shaped handle yoke 37 and extends about the first and second pulley members 18 and 19 downwardly, with the first cable's first end mounted to the U-shaped handle yoke 37 and the first cable's second end mounted medially of the carriage top edge 24, wherein the carriage top edge mounting eye 40 is formed through a carriage flange 61 extending upwardly of the carriage top edge 24 between the first and second support rods 12 and 13.

Figure 4:
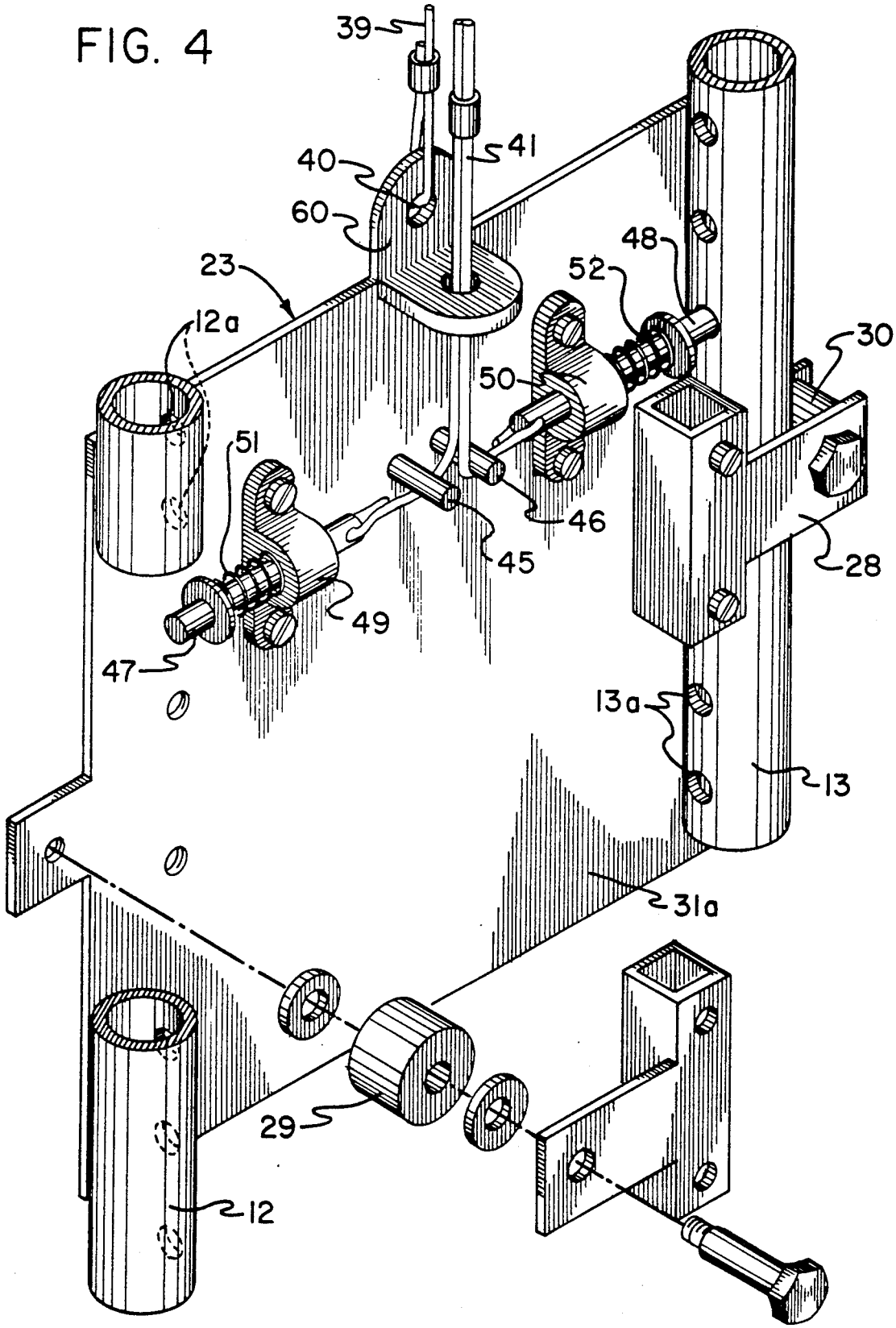
FIG. 4 is an isometric illustration of a slide plate utilized by the invention.
Figure 5:
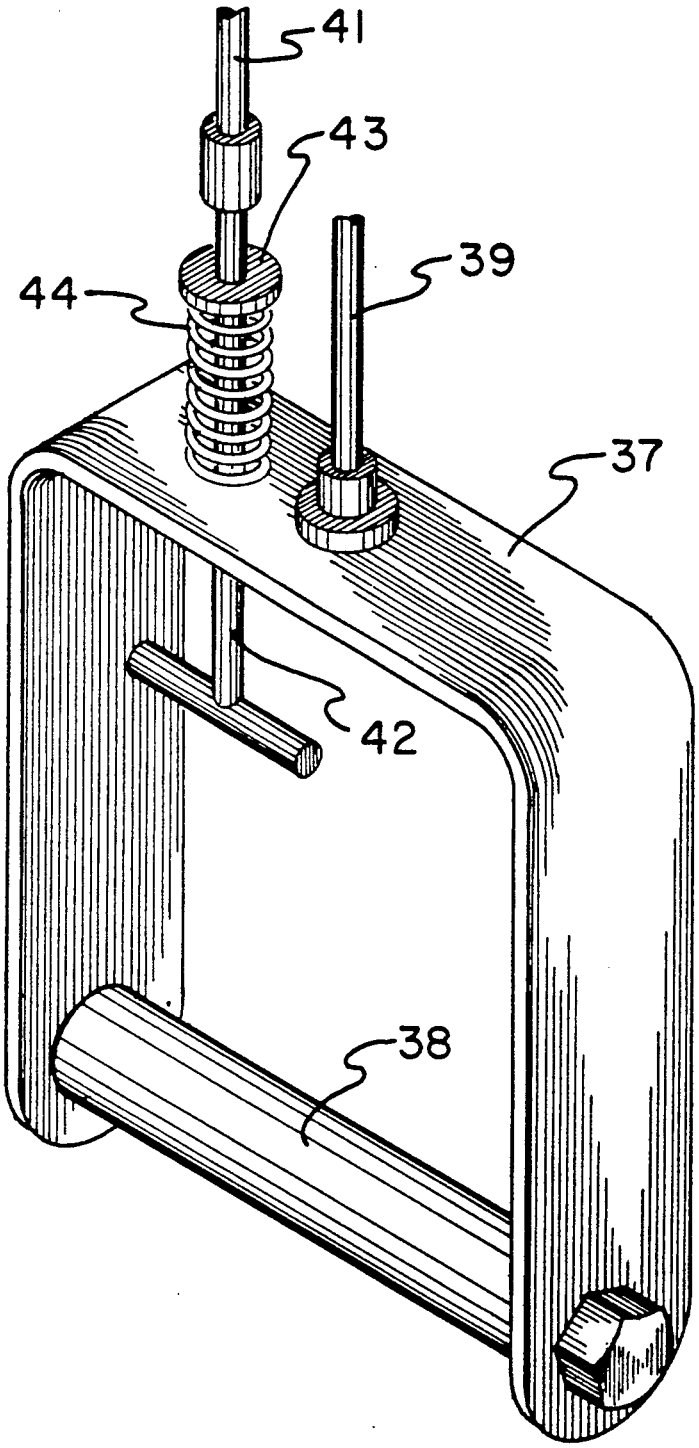
FIG. 5 is an isometric view of a handle structure of the invention.
Figure 6:
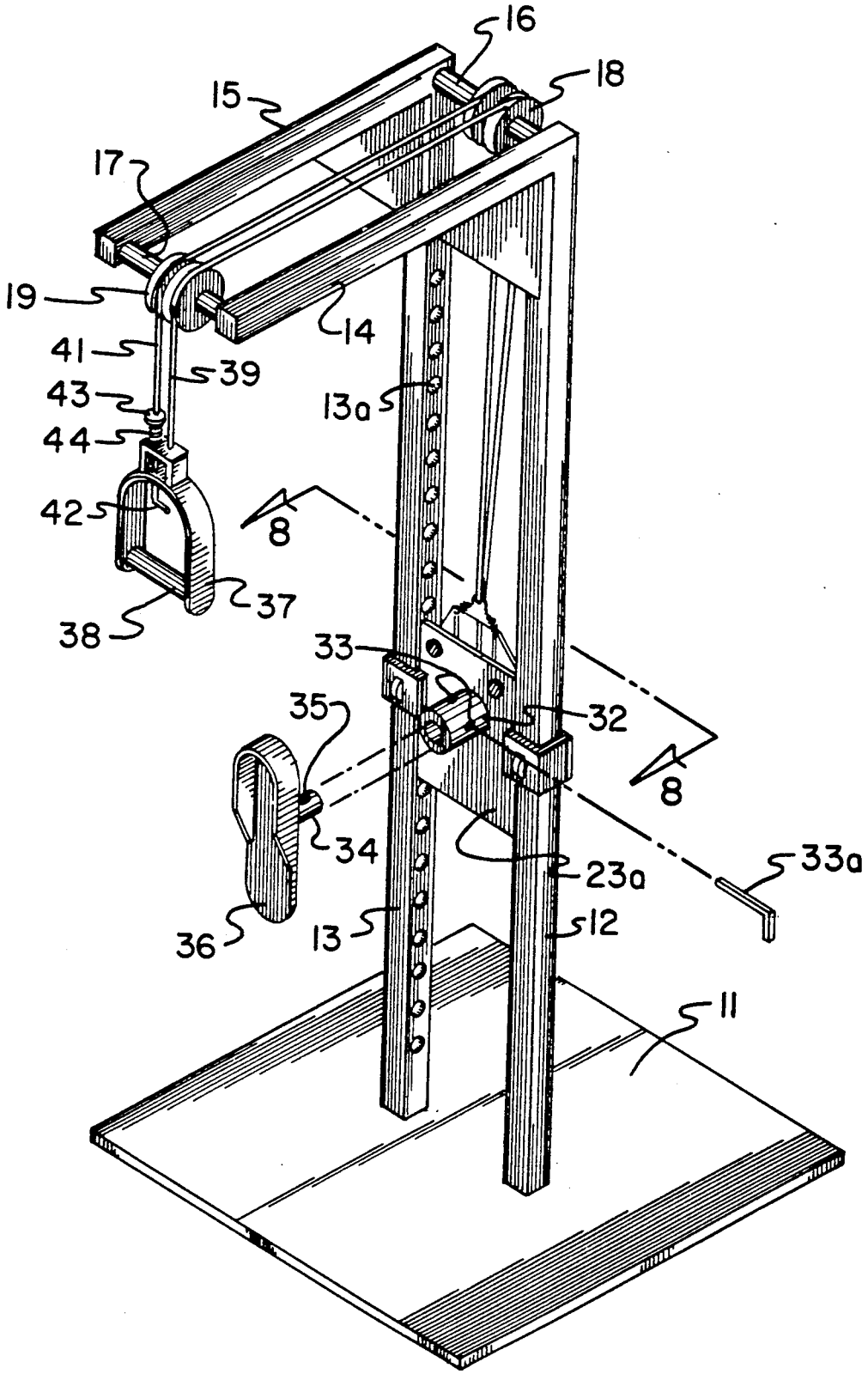
FIG. 6 is a further isometric view of the invention.
Figure 7:
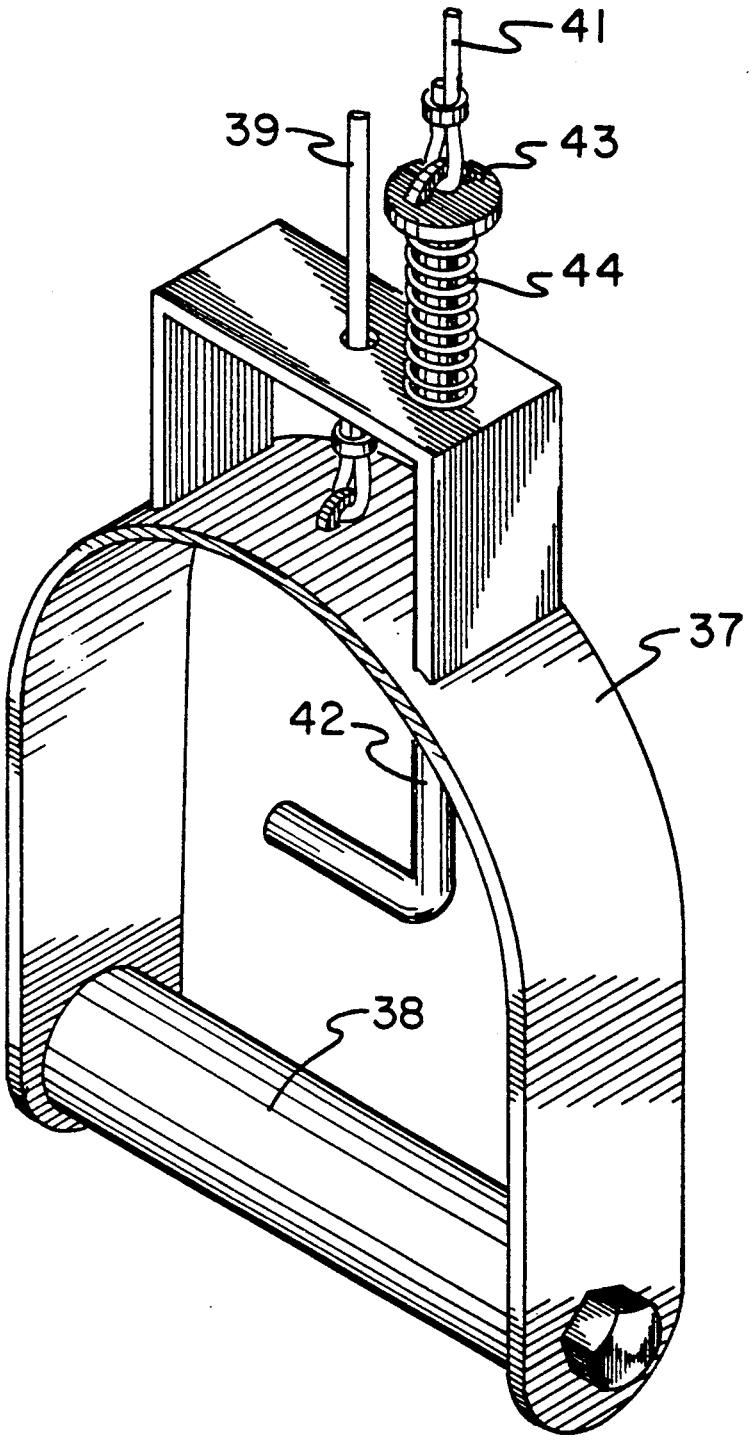
FIG. 7 is an isometric illustration of a further handle structure.

The U-shaped yoke 37 includes a second cable 44 mounted to a release rod 42 that extends through the handle yoke 37 between the handle yoke and the handlebar 38 to permit selective pulling of the second cable by the release rod 42. The release rod 42 includes an abutment plate 43 exteriorly of the U-shaped handle yoke 37 capturing a release rod spring 34 between the abutment plate 43 and the handle yoke 37 to effect minimizing tension on the second cable 41. The second end of the second cable 41 is arranged to extend along a carriage plate rear wall 31*a* , in a manner as indicated in FIG. 4 for example, split into a plurality of second ends, wherein first and second guide rods 45 and 46 orthogonally mounted to the carriage plate's rear wall 31*a* directs the second ends into respective first and second lock pins 47 and 48 and slidably mounted through respective first and second lock pin guide bosses 49 and 50 arranged for biasing from the guide bosses by respective first and second lock pin springs 51 and 52 to receive the respective lock pins within respective first and second support rod openings 12*a* and 13*a* of the associated and respective first and second support rods 12 and 13. The first and second support rod openings 12*a* and 13*a* are arranged in confronting relationship relative to one another, as indicated in FIG. 4 for example.

Figure 8:
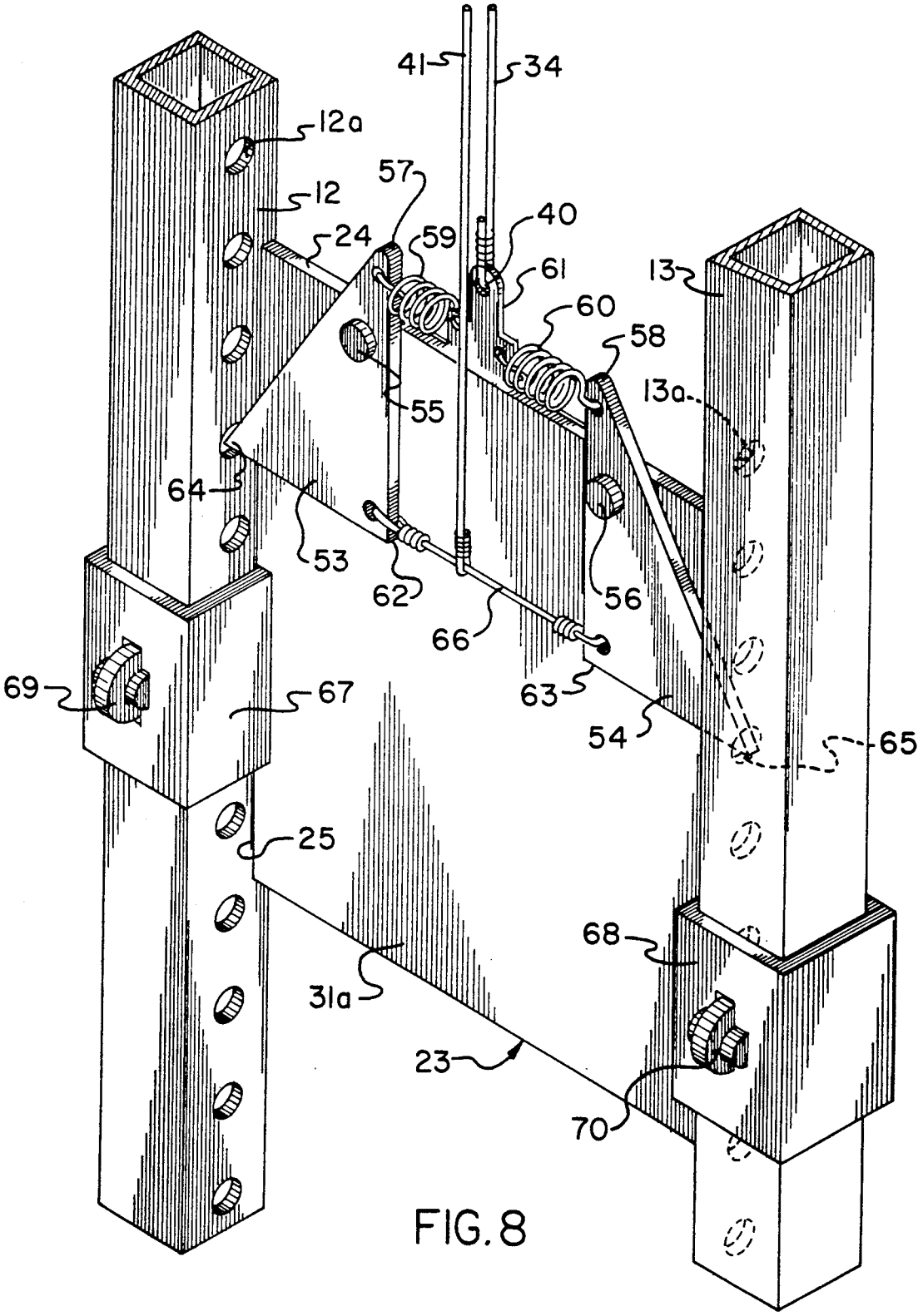
FIG. 8 is an isometric view of a further slide plate structure.

A modified carriage plate structure 23*a* is indicated in the FIG. 8 having respective first and second cam plates 53 and 54 rotatably mounted to the carriage plate's rear wall 31*a* about respective first and second cam plate axles 55 and 56 that are orthogonally mounted to their rear wall adjacent the carriage top edge 24 in a spaced relationship an equal distance relative to the slide carriage flange 61. First and second cam plate upper edges 57 and 58 project above the carriage top edge 24 and include respective first and second cam plate springs 59 and 60 extending between the first and second cam plate upper edges 57 and 58 and the slide carriage flange 61. A first and second cam plate interior edge 62 and 63 in confronting relationship include a flexible release cable 66 directed therebetween, with the second cable 41 mounted to the flexible release cable 66 such as upon tension of the second cable effects projection of the first and second cam plate interior edges 62 and 63 towards one another to effect removal of the first and second cam plate outer edges 64 and 65 from respective first and second support rod openings 12*a* and 13*a*. In this manner, an individual may effect tension of an individual's leg by pulling the associated handlebar 38 to effect lifting of the carriage plate 23, with an individual's foot mounted thereon. It should be understood that various straps and the like may be utilized to secure the individual's foot relative to the foot plate 36. To effect release of the carriage plate, the individual merely effects tensioning of the release rod 42 to effect displacement of the release cable 66 and removal of the associated first and second cam plate outer edges 64 and 65 relative to the first and second support rod openings 12*a* and 13*a*.

First and second guide sockets 67 and 68 slidably receive the first and second support rods 12 and 13 therethrough, with the first and second guide sockets including first and second guide socket wheels 69 and 70 in rotative communication with the first and second support rods to minimize frictional engagement of the first and second guide sockets 67 and 68 with the associated first and second support rods 12 and 13.

As to the manner of usage and operation of the instant invention, the same should be apparent from the above disclosure and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A leg stretching apparatus, comprising, a base plate, the base plate having a first support rod and a second support rod fixedly mounted to the base plate extending orthogonally relative to the base plate in a parallel relationship relative to one another, and a first support beam orthogonally mounted to the first support rod and a second support beam mounted orthogonally to the second support rod, wherein the first support beam and the second support beam are arranged in a parallel coextensive relationship relative to one another, and a first pulley axle, the first pulley axle mounted orthogonally between the first support beam and the second support beam, a second pulley axle mounted orthogonally between the first support beam and the second support beam in a spaced parallel relationship relative to the first pulley axle, a first pulley member rotatably mounted about the first pulley axle, a second pulley member mounted about the second pulley axle, and a slide carriage plate slidably mounted between the first support rod and the second support rod below the first support beam and the second support beam, and the carriage plate having a carriage top edge, a carriage first side edge and a carriage second side edge, a first guide socket mounted to the first side edge and a second guide socket mounted to the second side edge, the first guide socket slidably receiving the first support rod therethrough, the second guide socket slidably receiving the second guide socket therethrough, and a first cable, and a U-shaped handle yoke, the first cable having first cable first end mounted to the U-shaped handle yoke, and the first cable having a first cable second end mounted medially of the carriage top edge, the handle yoke having a handlebar spaced below the first cable, and the carriage plate having a carriage plate front wall, the front wall having a tubular socket, the tubular socket including an annular array of tubular socket apertures diametrically directed through the tubular socket, and a cylindrical mounting shaft slidably received within the tubular socket, the cylindrical mounting shaft having an annular array of shaft apertures directed diametrically through the cylindrical mounting shaft, where one of the shaft apertures is arranged for alignment with one of the socket apertures, and a lock pin arranged for sliding projection through said one socket aperture and said one shaft aperture, and a foot plate fixedly and orthogonally mounted to the cylindrical mounting shaft.

2. An apparatus as set forth in claim 1 wherein a first pulley member is rotatably mounted about the first plate axle, and a second pulley member mounted about the second plate axle, wherein the first cable is wound about the first pulley member and the second pulley member, and a second cable, the second cable having a second cable first end, with the second cable first end fixedly secured to a release rod, the release rod directed through the U-shaped handle yoke and extending between the handle yoke and the handlebar, and the release rod having an abutment plate positioned above the handle yoke, with a release rod spring captured between the abutment plate and the U-shaped handle yoke, the second cable having a second cable second end directed to the carriage plate, and release means for selectively arresting and releasing the carriage plate relative to the first support rod and the second support rod, and the second cable second end in operative communication with the release means for effecting selective release means relative to the first support rod and the second support rod.

3. An apparatus as set forth in claim 2 wherein the carriage plate includes a carriage plate rear wall, and the carriage plate rear wall includes a first cam plate and a second cam plate, with the first cam plate rotatably mounted about a first cam plate axle, the second cam plate rotatably mounted about a second cam plate axle, with the first cam plate axle and the second cam plate axle arranged orthogonally and fixedly to the carriage plate rear wall in adjacency to the carriage top edge, and the first cam plate having a first cam plate upper edge, the second cam plate having a second cam plate upper edge, with the first cam plate upper edge and the second cam plate upper edge projecting above the carriage top edge, and a slide carriage flange fixedly mounted to the carriage top edge projecting therearbove, with the first cable second end mounted to the slide carriage flange, and a first cam plate spring extending between the first cam plate upper edge and the slide carriage flange, and a second cam plate spring extending between the second cam plate upper edge and the slide carriage flange.

4. An apparatus as set forth in claim 3 wherein the first cam plate and the second cam plate include respective first and second cam plate interior edges arranged in confronting adjacency relative to one another, and a flexible release cable directed between the first cam plate interior edge and the second cam plate interior edge, and the second cable second end secured medially of the flexible release cable, the first cam plate and the second cam plate having respective first cam plate and second cam plate outer edges, and the first support rod includes first support rod openings, and the second support rod includes second support rod openings arranged in confronting relationship relative to one another, with the second cam plate outer edge and the first cam plate outer edge received within respective second support rod openings and the first support rod openings, whereupon tensioning of the second cable effects deflection of the flexible release cable displacing the first cam plate outer edge and the second cam plate outer edge from one of said first support rod openings and one of said second support rod openings.

5. An apparatus as set forth in claim 4 wherein the first guide socket includes a first socket wheel rotatably mounted to the first guide socket in communication with the first support rod, and the second guide socket includes a second guide socket wheel rotatably mounted within the second guide socket in communication with the second support rod.

* * * * *